US006914378B2

(12) United States Patent
Jung

(10) Patent No.: US 6,914,378 B2
(45) Date of Patent: Jul. 5, 2005

(54) COLOR CATHODE RAY TUBE PANEL HAVING SEAL EDGE CORNER WITH A SPECIFIC CURVATURE

(75) Inventor: Sung Han Jung, Gyeongsangbook-do (KR)

(73) Assignee: LG. Philips Displays Korea Co., Ltd., Gumi-si (KR)

( * ) Notice: Subject to any disclaimer, the term of this patent is extended or adjusted under 35 U.S.C. 154(b) by 170 days.

(21) Appl. No.: 10/366,663

(22) Filed: Feb. 14, 2003

(65) Prior Publication Data

US 2003/0151349 A1 Aug. 14, 2003

(30) Foreign Application Priority Data

Feb. 14, 2002 (KR) ..... 10-2002-0007956

(51) Int. Cl.[7] ..... H01J 31/00; H01J 29/86
(52) U.S. Cl. ..... 313/477 R; 220/2.1 A
(58) Field of Search ..... 313/477 R, 461, 313/422, 364; 220/2.1 A, 2.1 R, 2.3 A; 348/822

(56) References Cited

U.S. PATENT DOCUMENTS 2,837,235 A * 6/1958 Vincent ..... 220/2.3 A
3,002,645 A * 10/1961 Kegg ..... 220/2.1 A
6,011,350 A * 1/2000 Opresko et al. ..... 313/477 R
6,555,951 B2 * 4/2003 Jeoung ..... 313/408

FOREIGN PATENT DOCUMENTS

JP 9-171784 A 6/1997
JP 11-086753 A 3/1999
JP 2001-325899 A 11/2001

* cited by examiner

*Primary Examiner*—Karabi Guharay
(74) *Attorney, Agent, or Firm*—Birch Stewart Kolasch & Birch, LLP

(57) ABSTRACT

A color cathode ray tube is capable of reducing a rate of cracks in a furnace and improving the productivity of the CRT by improving a structure of a seal edge of a skirt of a panel. A color cathode ray tube according to the present invention includes a rectangular panel having a substantially vertically extending skirt on inner and outer surfaces of the panel and a funnel coupled to a seal edge of the skirt of the panel. The seal edge of the skirt of the panel has a corner having a specific curvature between a seal surface and a side of the skirt, and the following relationship is satisfied: 0.6 mm<W<1.0 mm, where W is the shortest distance from a starting point on the seal surface of the corner to an extension plane of the side of the skirt.

19 Claims, 11 Drawing Sheets

COLOR CATHODE RAY TUBE PANEL HAVING SEAL EDGE CORNER WITH A SPECIFIC CURVATURE

This nonprovisional application claims priority under 35 U.S.C. § 119(a) on Patent Application No. 7956/2002 filed in Korea on Feb. 14, 2002, which is herein incorporated by reference.

BACKGROUND OF THE INVENTION

1. Field of the Invention

The present invention relates generally to a color cathode ray tube, and more particularly to a color cathode ray tube capable of reducing heat damage that occurs during heat treatment, while at the same time enhancing productivity by improving a structure of skirt seal edges of a flat panel.

2. Description of the Background Art

FIG. 1 is a partial sectional view showing a structure of a general color cathode ray tube (CRT).

Referring to FIG. 1, as a main element for realizing pictures in a picture display apparatus such as a television receiver or a computer monitor, a color CRT generally comprises a panel 1 arranged in the front of the color CRT and a funnel 2 arranged in the rear of the panel 1.

In addition, in an inner space formed by the panel 1 and the funnel 2, the color CRT further includes a fluorescent screen 4 for emitting light, an electron gun provided within a neck portion of the funnel 2 for projecting an electron beam 6 for emitting light from the fluorescent screen 4, a shadow mask 3 for selecting color so that light is emitted from the fluorescent screen 4, a frame assembly including a main frame 7 for applying tension to the shadow mask 3 and a sub frame 13 for supporting the shadow mask 3, a spring 9 provided at a side face of the main frame 7 for coupling the frame assembly 7 to the panel 1, an inner shield 8 welded and fixed to the sub frame 13 for shielding an external earth magnetic field, and a reinforcement band 12 provided at an outer face of a skirt of the panel 1 for dispersing stress given to the CRT in a state of high vacuum and securing impact-resistant performance.

In addition, the outside the neck of the funnel 2 is provided with a deflection yoke 5 for deflecting the electron beam 6 projected from the electron gun (not shown) in various directions, i.e., up, down, left and right and 2, 4 and 6-pole magnets for correcting a traveling locus of the projected electron beam 6 so that the projected electron beam 6 precisely strikes a prescribed fluorescent substance for the purpose of preventing staining, which affects color purity.

Processes for manufacturing the color CRT generally comprising a glass (the panel and funnel), the shadow mask, the electron gun, the fluorescent screen, the deflection yoke, etc. as shown in the above, and will now be briefly explained below.

The processes include a shadow mask assembly process, a black matrix (BM) process and a phosphor (PH) application process for repeatedly performing a clean, an application, a dry, an exposure, and a development of the shadow mask such that pixels conforming to a particular specification are formed, an aluminum deposition process for depositing aluminum on a panel to which a fluorescent substance is applied, a panel baking process for passing an assembly as a combination of the panel and the shadow mask and carried on a panel holder through a stabilizing furnace or a panel baking furnace in order to eliminate internal stress of the panel and the shadow mask, a frit process for making a bulb by welding the panel and the shadow mask to a funnel to which frit glass is applied, an enclosure process for inserting an electron gun into a funnel neck of the bulb, and an exhaust process for placing the bulb into a state of high vacuum using a rotary pump and a diffusion pump while the bulb passes through a high-temperature furnace and for discharging gas filled in electrodes and dissolving a cathode by removing the occlusion and absorption gases in the bulb.

On the other hand, in connection with a recent trend of size enlargement and flatness of the color CRT, there is a significant problem in the aforementioned manufacture processes of the CRT, particularly, the frit process in which the panel is welded to the funnel. For example, when the frit having a property of melt and recrystallization at high temperature is applied to the welding portion of the panel to the funnel, the frit does not provide a complete enclosure to seal the surfaces of the panel and the funnel and flows down around the funnel (see FIG. 10*a*). When the frit flows down around the funnel due to its low viscosity, an acute angle and a droop of the frit are generated causing a crack in the bulb.

The shape of the frit applied to the welding portion of the panel and the funnel and bubbles formed within the frit are responsible for cracks caused by heat stress and vacuum stress. A main reason for the shape and the bubbles is the steep flow of the frit.

The reason for such a steep flow of the frit is mainly due to the trend of size enlargement and flatness of the color CRT. Namely, the frit has steep flow because the panel whose outer surface is flat (see FIG. 2*b*) has a structure in which the weight of the panel increases due to the enlargement and flatness of the CRT, thus creating the enlargement and flatness of the panel.

Herein, when the frit is recrystallized, the flow of the frit on the welding portion of the panel and the funnel increases due to the increased weight of the panel. Therefore, the panel (after recrystallization) of the frit has a shape different from a general shape under the same conditions, i.e., a high fin shape.

Typically, the weight of the flat panel (see FIG. 2*b*) is increased over a curved panel (see FIG. 2*a*). As a result, the force of the panel that presses against the funnel in a frit sealing furnace is increased, thus changing the flow of the frit. Since much of the frit flows down around the seal surface of the funnel due to insufficient time for the frit to cover the seal surface of the panel and the relative increase of the force pressing on the panel, an acute angle (the source of the crack of the panel) is formed at the end portion of the seal surface of the panel.

Particularly, the recent trend of size enlargement and flatness of current panels leads to an increase in the thickness of the panel, making it heavier, which gives rise to the significant problem of the bulb crack.

To overcome such a problem, a furnace schedule should be changed. However, when such a change is made, there arises the more significant problem of reduction in the quantity of products, i.e., product index, for the CRT.

SUMMARY OF THE INVENTION

Accordingly, the present invention has been made keeping in mind the above problems (occurring in the background art), and an object of the present invention is to provide a color cathode ray tube having a panel, which is capable of lowering the rate of cracking in a furnace during heat treatment, and improving productivity for the CRT without any change of product index.

In order to accomplish the above object, the present invention provides a color cathode ray tube comprising a rectangular panel having a substantially vertically extending skirt on inner and outer surfaces of the panel and a funnel coupled to a seal edge of the skirt of the panel, wherein the seal edge of the skirt of the panel has a corner having a specific curvature between a seal surface and a side of the skirt, and the following relationship is satisfied: 0.6 mm<W<1.0 mm, where W is the shortest distance from a starting point on the seal surface of the corner to an extension plane of the side of the skirt.

In addition, the present invention provides a color cathode ray tube comprising a rectangular panel having a substantially vertically extending skirt on inner and outer surfaces of the panel and a funnel coupled to a seal edge of the skirt of the panel, wherein the seal edge of the skirt of the panel has a corner having a specific curvature between a seal surface and a side of the skirt, and the following relationship is satisfied: 0.3 mm<H2<0.6 mm, where H2 is the shortest distance from a middle portion of the corner to a seal plane.

In addition, the present invention provides a color cathode ray tube comprising a rectangular panel having a substantially vertically extending skirt on inner and outer surfaces of the panel and a funnel coupled to a seal edge of the skirt of the panel, wherein the seal edge of the skirt of the panel has a corner having a specific curvature between a seal surface and a side of the skirt, the corner includes an inclination portion directing from the seal surface to the side of the skirt, a middle portion extending substantially parallel to the seal surface from an end portion of the inclination portion to the side of the skirt, and a curvature portion formed to have a specific curvature radius from an end portion of the middle portion to the side of the skirt, the curvature portion being not protruded from at least the middle portion to the seal surface, and the following relationship is satisfied: 0.1 mm<R<0.6 mm, where R is a curvature radius of the curvature portion.

Preferably, the corner having the specific curvature is a single curvature or a complex curvature.

Preferably, the panel has a substantially flat outer surface and an inner surface having a specific curvature.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF PREFERRED EMBODIMENTS

Hereinafter, the present invention will be described in detail through preferred embodiments with reference to the accompanying drawings.

Figure 1:
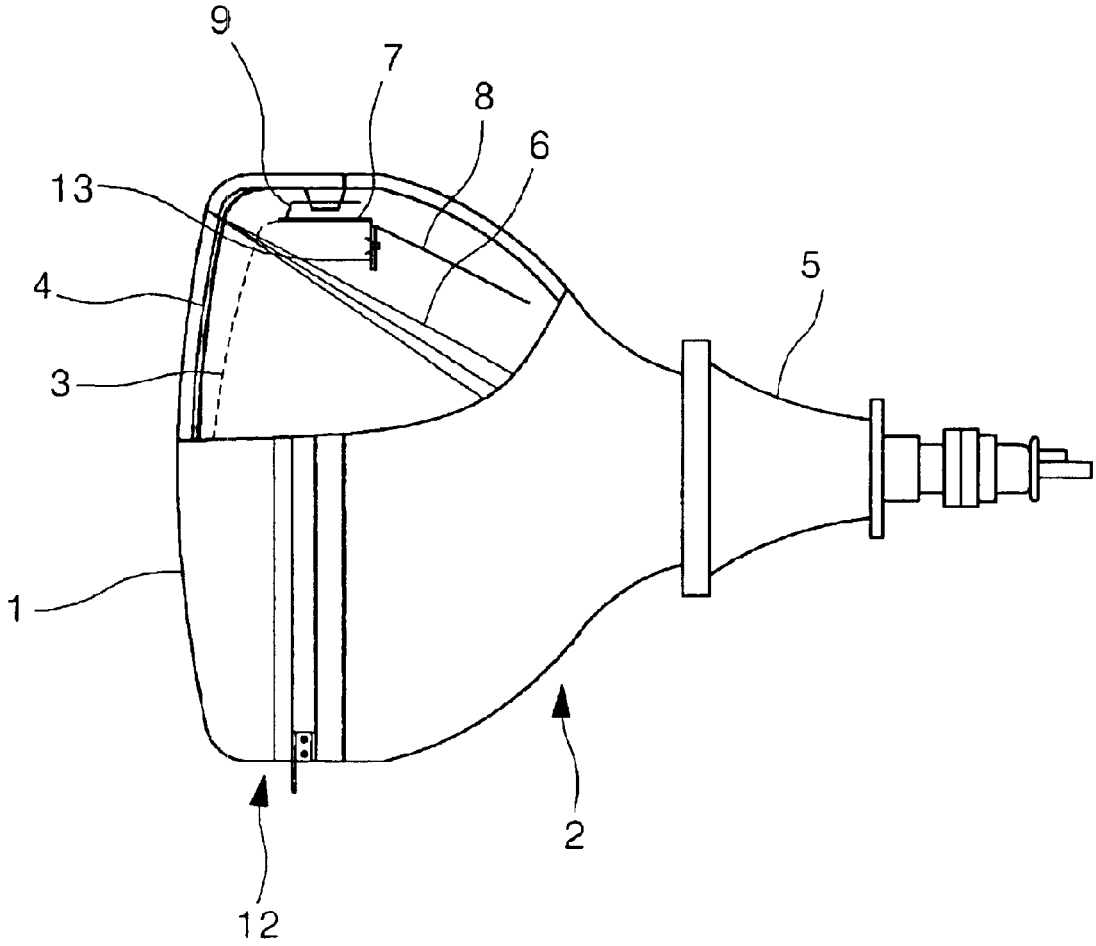
FIG. 1 (Background Art)
FIG. 1 is a schematic sectional view showing a structure of a general color cathode ray tube.
Figure 2A:
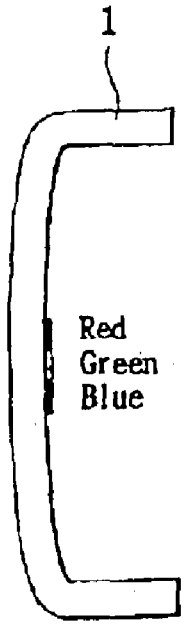
Fig. 2A (Related Art)
FIGS. 2*a* and 2*b* are views showing structures of a flat panel having a curvature of its outer surface and a flat panel having little curvature of its outer surface, respectively.
Figure 2B:
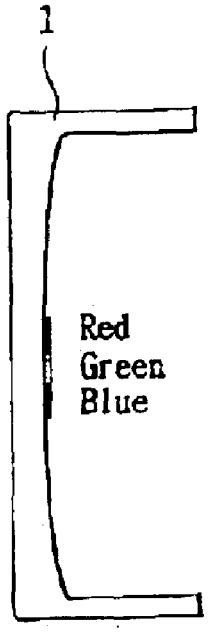
Fig. 2B (Related Art)
Figure 3:
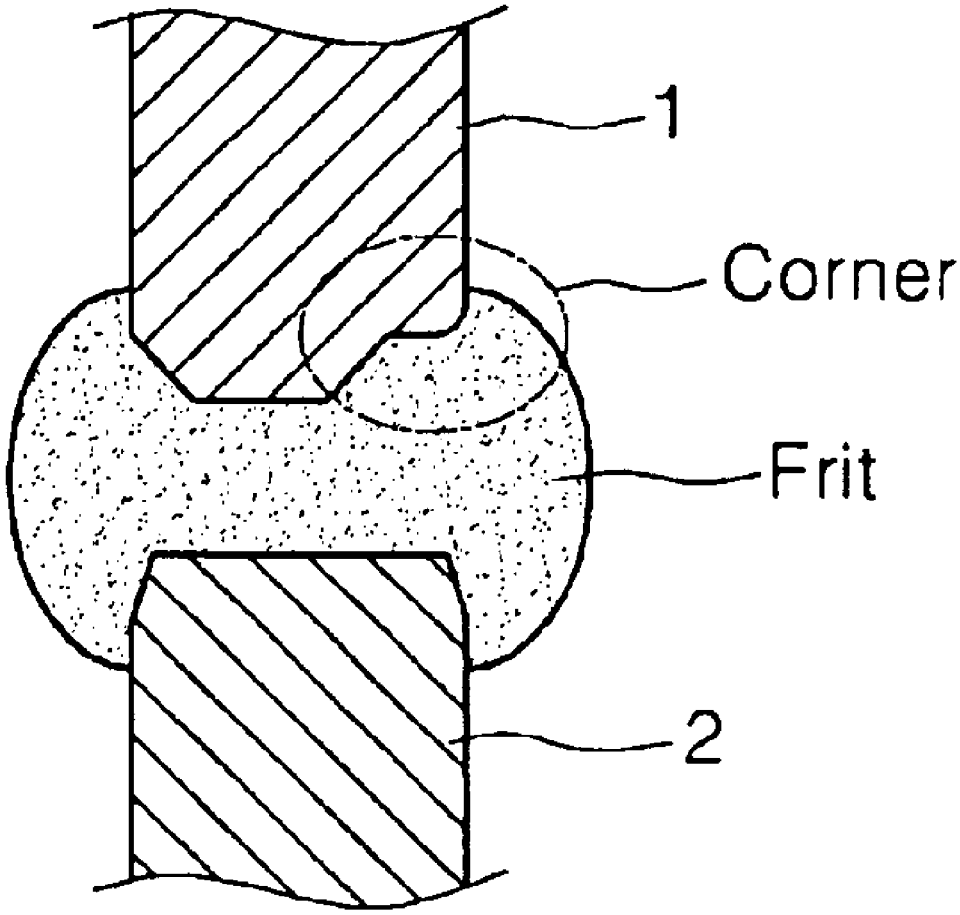
FIG. 3 (Background Art)
FIG. 3 is a view showing a structure of a skirt seal edge of a general flat panel.

FIG. 3 is a view showing a structure of a skirt seal edge of a general flat panel.

Referring to FIG. 3, a structure in which a skirt seal edge of a panel 1 is welded to a funnel 2 by using the frit is shown in detail. A corner having a specific curvature is formed in the panel seal edge.

Figure 4:
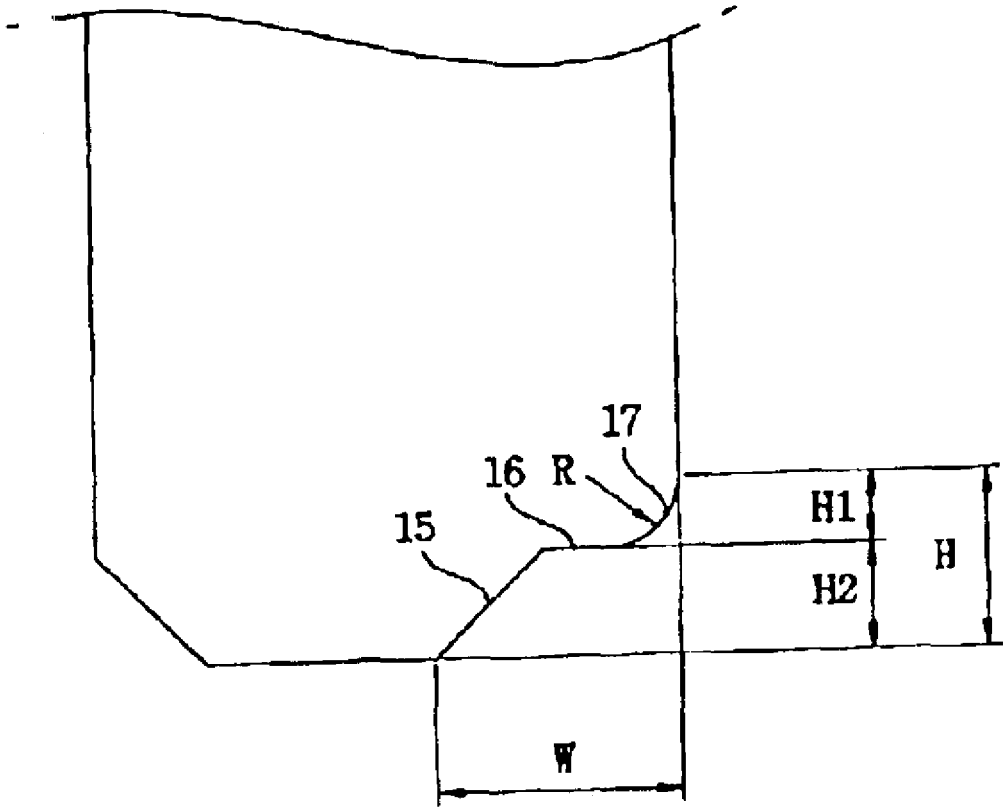
FIG. 4 is a view showing a structure of a skirt seal edge of a panel according to the present invention.

FIG. 4 is a view showing a structure of the skirt seal edge of a flat panel according to the present invention.

Herein, a corner having a specific curvature, either a single curvature or a complex curvature, is formed between a seal surface and a side of the skirt in the seal edge of the panel.

Figure 10A:
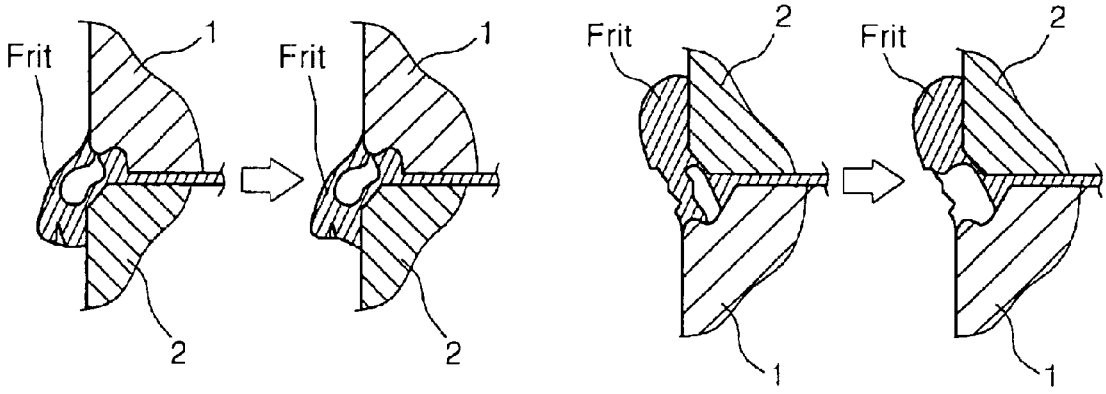
FIG. 10A (Background Art)
FIGS. 10*a* and 10*b* are photographs showing a conventional shape of a frit and that of the present invention, respectively, of a seal edge of a panel skirt.

Referring to FIG. 4, particularly, the corner has a mixed curved plane including an inclination portion 15 directing from the seal surface to the side of the skirt, a middle portion 16 extending substantially parallel to the seal surface from an end portion of the inclination portion to the side of the skirt, and a curvature portion 17 formed to have a specific curvature radius from an end portion of the middle portion to the side of the skirt. Herein, the curvature portion 17 has to have a shape not protruded toward the seal surface beyond the middle portion 16, that is, a shape which does not form a high fin (as shown in FIG. 10*a*).

In FIG. 4, the shortest distance (the width of the corner) from a starting point on the seal surface of the seal edge of the panel skirt to an extension plane of the side of the skirt is defined as W, and the shortest distance (the height of the corner) from the middle portion 16 of the corner to a seal plane is defined as H2. In addition, the height of the corner H is composed of the height H1 from the starting point of the side of the skirt of the corner to the middle portion and the height H2 from the middle portion to the seal plane.

Figure 5:
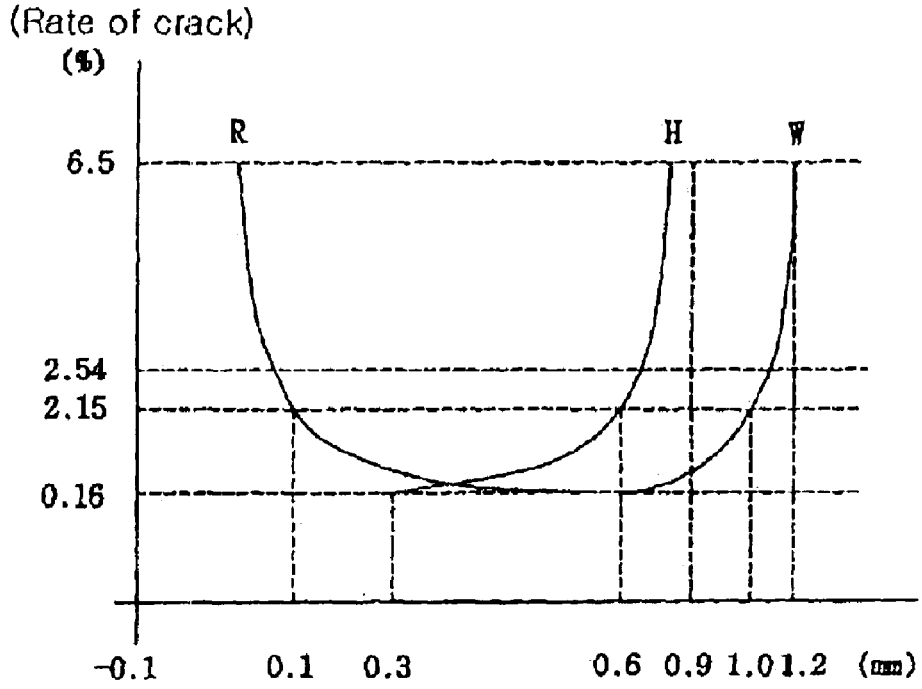
FIG. 5 is a graph showing a relationship between heat cracks in a furnace and a design value of a structure of a seal edge of the present invention.

FIG. 5 is a graph showing a relationship between heat cracks in a furnace and a design value of a structure of a seal edge of the present invention. FIG. 5 shows a rate of crack (%) with respect to the shortest distance (the width of the corner) W from the starting point on the seal surface of the seal edge of the panel skirt to an extension plane of the side of the skirt, the shortest distance (the height of the corner) H from the starting point of the side of the skirt of the corner to the seal plane, and the curvature radius R of the curvature portion.

As shown in FIG. 5, the shortest distance (the width of the corner) W from the starting point on the seal surface of the seal edge of the panel skirt to an extension plane of the side of the skirt is one of the factors used in determining a degree of gradient of the inclination portion of the corner, the length of the middle portion and the curvature radius of the curvature portion shown in FIG. 4. When the width of the corner W is less than 1.0 mm, a rate of the heat crack in the furnace is less than 2.15%.

If the width of the corner W is more than 1.0 mm, the quantity of the frit is increased as the volume of the corner is increased. For this reason, a flow property of the frit is deteriorated and time taken for releasing the bubbles formed within the frit is increased. Therefore, since an extension of a furnace schedule becomes necessary which results in the reduction of the productivity), the cost of products is raised. On the other hand, if the width of the corner W is less than 0.6 mm, it is difficult to form the corner of the seal edge of the panel skirt precisely by use of a mould.

Figure 6:
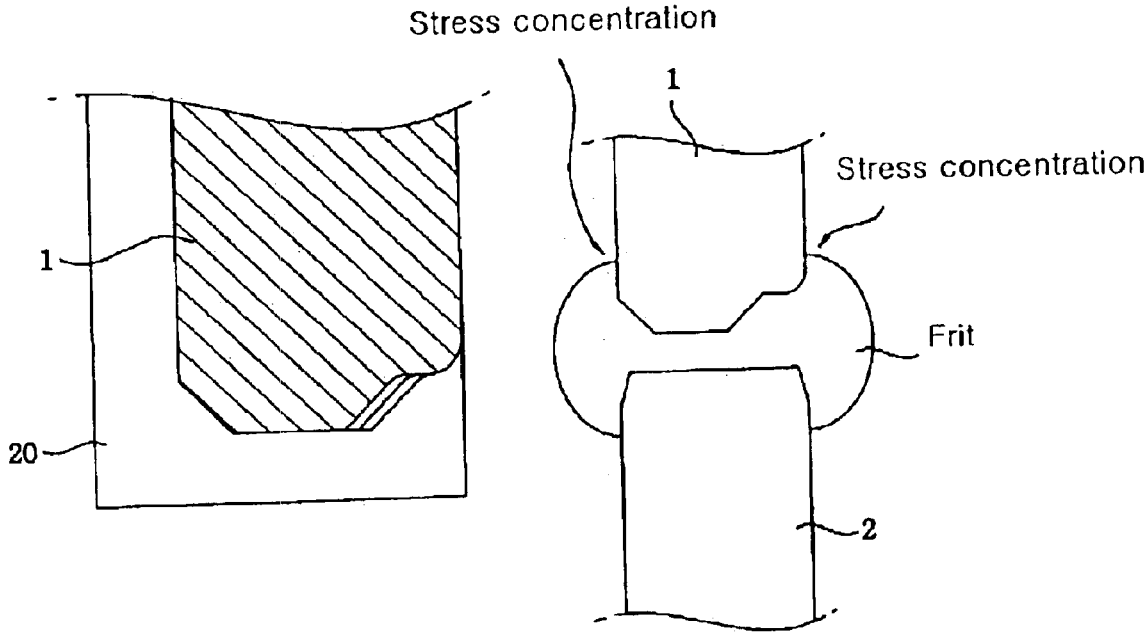
FIG. 6 is a view showing an example of a mould for use in forming the width W of a corner on a seal surface of a panel skirt according to the present invention.

FIG. 6 is a view showing an example of a mould 20 for use in forming the width W of the corner on the seal surface of the panel skirt according to the present invention. As shown in FIG. 6, it is possible to modify the width of the corner of the seal edge of the skirt panel by changing an inner configuration of the mould 20.

In addition, when the shortest distance H2 from the middle portion of the corner to the seal plane becomes more than 0.3 mm but less than 0.6 mm, the rate of cracks in the furnace can be reduced.

If the height of the corner is less than 0.3 mm, the curvature portion having the specific curvature radius cannot be sufficiently enclosed by the frit due to delayed flow of the frit. Therefore, the corner is susceptible to heat stress and vacuum stress generated at the welding portion of the panel and the funnel. If the height of the corner H2 is more than 0.6 mm, since a corner cannot be sufficiently enclosed by the frit, the corner is susceptible to heat stress and vacuum stress generated at the welding portion of the panel and the funnel.

Figure 7:
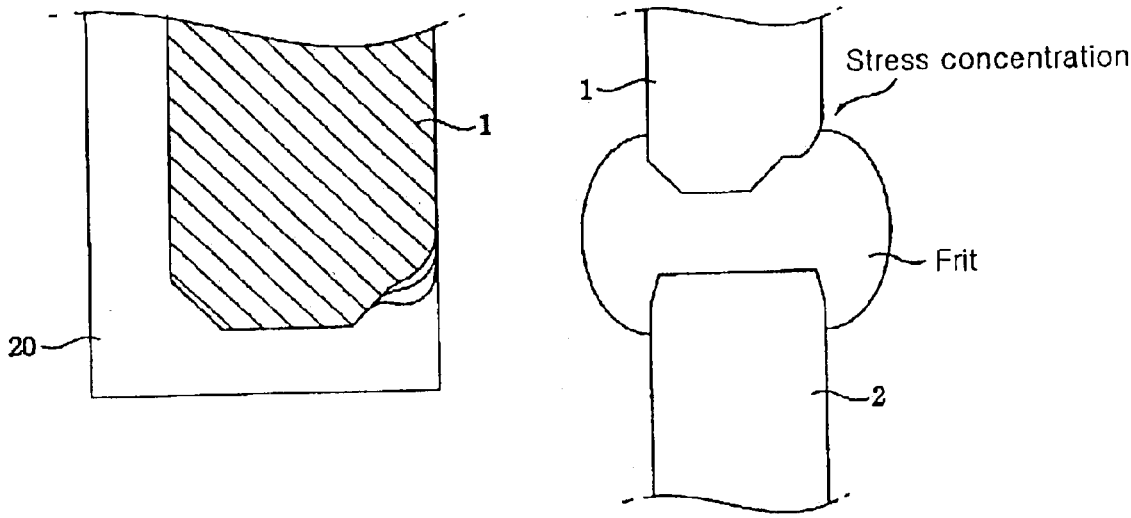
FIG. 7 is a view showing an example of a mould for use in forming the height H2 of a corner on a side of a panel skirt according to the present invention.

FIG. 7 is a view showing an example of the mould 20 for use in forming the height H2 of the corner on the side of the panel skirt according to the present invention. As shown in FIG. 7, it is possible to modify the height of the corner of the seal edge of the skirt panel by changing the inner configuration of the mould 20.

In addition, when the curvature radius R of the curvature portion formed from the end portion of the middle portion 16 of the corner of the panel seal edge to the side of the skirt becomes more than 0.1 mm but less than 0.6 mm, the rate of cracks in the furnace can be reduced (see FIG. 5).

Figure 8:
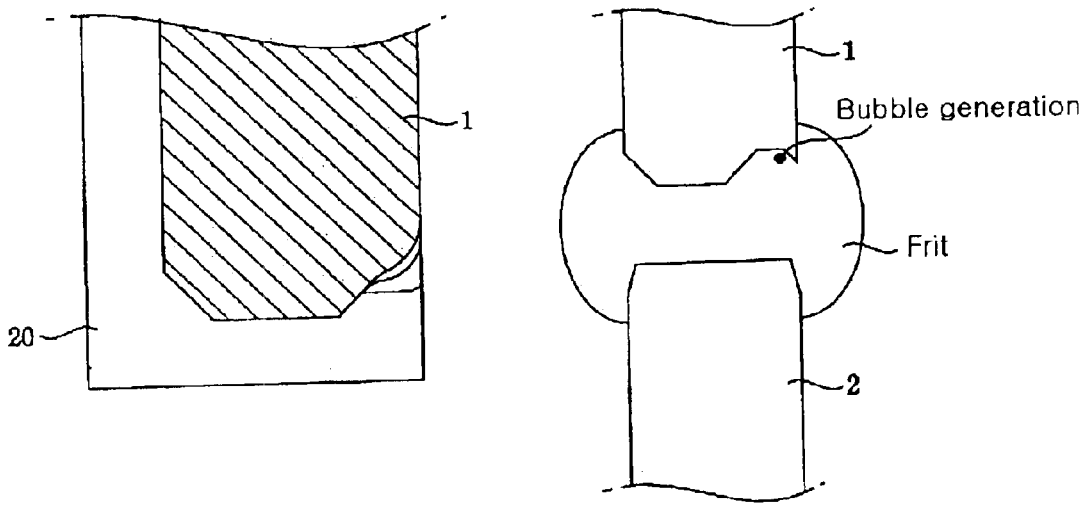
FIG. 8 is a view showing an example of a mould for use in forming a curvature radius R of a corner on a side of a panel skirt according to the present invention and a frit bubble generated by a projector (high-pin) on an outer portion of an end of a curvature portion.

If the curvature radius R is less than 0.1 mm, frit bubbles are accumulated by a projector (high-fin) generated at the outer portion of the end of the curvature portion, as shown in FIG. 8. In addition, if the curvature radius R is more than 0.6 mm, the height of the corner becomes too large. Therefore, since the corner cannot be sufficiently enclosed by the frit, it is susceptible to heat stress and vacuum stress generated at the welding portion of the panel and the funnel.

Although the width and height H2 of the corner W and the curvature radius R of the curvature have been individually described in the above, a more desirable effect for the reduction of the rate of heat cracks in the furnace can be obtained when the width and height H2 of the corner W and the curvature radius R of the curvature satisfy at least two of the following three relationships.

$$0.6\ \text{mm} < W < 1.0\ \text{mm} \quad (1)$$

$$0.3\ \text{mm} < H2 < 0.6\ \text{mm} \quad (2)$$

$$0.1\ \text{mm} < R < 0.6\ \text{mm} \quad (3)$$

Figure 9A:
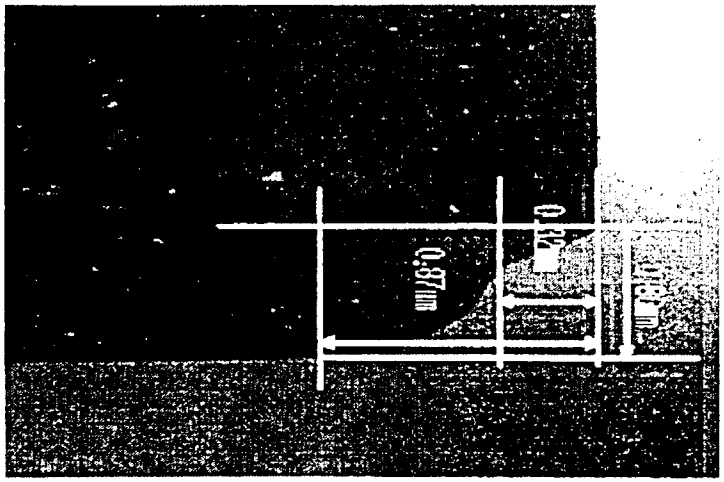
FIGS. 9*a* and 9*b* are photographs showing shapes of seal edges of a panel skirt designed according to the present invention, respectively.
Figure 9B:
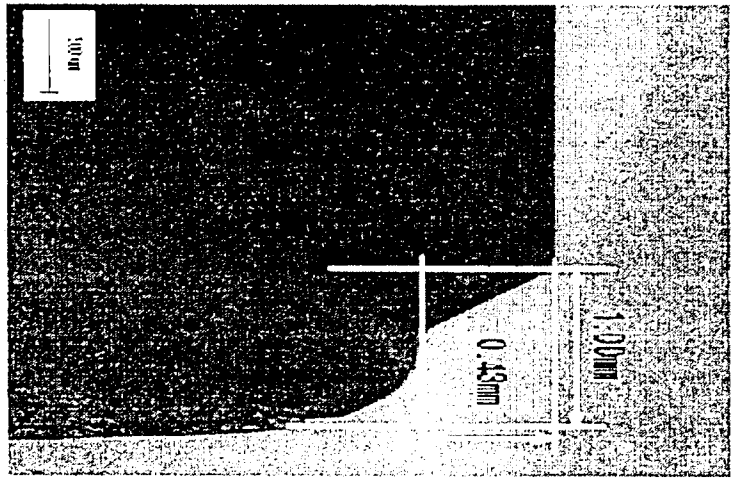

FIGS. 9*a* and 9*b* are photographs showing shapes of seal edges of a panel skirt designed according to the present invention, respectively. From the photographs, it can be seen that the curvature portion is not protruded above the middle portion, that is, the high-fin is not formed.

FIG. 10*a* is a drawing showing a conventional shape of the seal edge and an accompanying frit shape. From the drawing, it can be seen that the welding portion of the panel and the funnel is not sufficiently enclosed by the frit. In such a case, an acute angle and a droop of the frit are generated, which result in cracks of the bulb.

Figure 10B:
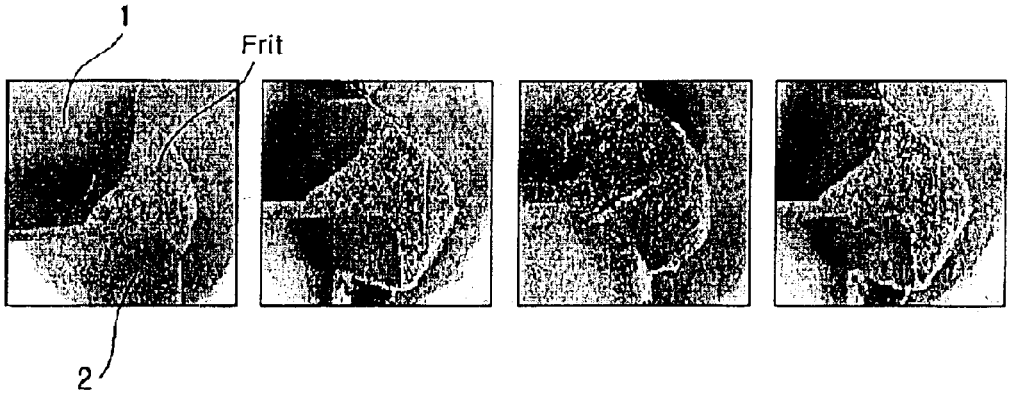

FIG. 10*b* is a photograph showing a shape of the panel seal edge formed according to the present invention and an accompanying frit shape. From the photograph, it can be seen that the welding portion of the panel and the funnel is sufficiently enclosed by the frit having a uniform shape.

As described above, when a treated panel and a treated funnel to be used in the color cathode ray tube are coupled to each other and then introduced in a frit sealing furnace, the frit is dissolved under the conditions of the temperature of the frit sealing furnace to thereby accomplish a complete combination of the panel and the funnel so that a bulb for maintaining vacuum on the inside of the CRT results. During the process of making the bulb, bubbles can be formed due to the high-fin generated in the panel seal edge, which results in cracks in the bulb.

Particularly, such a problem is remarkable in the flat color CRT having a panel whose outer surface is substantially flat and whose inner surface has a specific curvature.

Therefore, according to the present invention, by improving a shape of the seal edge of the panel skirt of the flat color CRT during the process of making the bulb, the rate of cracks in the furnace can be lowered and the productivity for the CRT can be improved without any change of product index.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A color cathode ray tube comprising a rectangular panel having a substantially vertically extending skirt on inner and outer surfaces of the panel and a funnel coupled to a seal edge of the skirt of the panel, wherein the seal edge of the skirt of the panel has a corner having a specific curvature between a seal surface and a side of the skirt, and the following relationship is satisfied:

$$0.6\ \text{mm} < W < 1.0\ \text{mm},$$

where W is the shortest distance from a starting point on the seal surface of the corner to an extension plane of the side of the skirt.

2. The color cathode ray tube according to claim 1, wherein the following relationship is satisfied:

$$0.3\ \text{mm} < H2 < 0.6\ \text{mm},$$

where H2 is the shortest distance from a middle portion of the corner to a seal plane.

3. The color cathode ray tube according to claim 1, wherein the corner includes an inclination portion facing in the direction from the seal surface to the side of the skirt, a middle portion extending substantially parallel to the seal surface from an end portion of the inclination portion to the side of the skirt, and a curvature portion formed to have a specific curvature radius from an end portion of the middle portion to the side of the skirt, the curvature portion being not protruded from at least the middle portion to the seal surface, and the following relationship is satisfied:

$$0.1\ \text{mm} < R < 0.6\ \text{mm},$$

where R is a curvature radius of the curvature portion.

4. The color cathode ray tube according to claim 1, wherein the corner includes an inclination portion facing in the direction from the seal surface to the side of the skirt, a middle portion extending substantially parallel to the seal surface from an end portion of the inclination portion to the side of the skirt, and a curvature portion formed to have a specific curvature radius from an end portion of the middle portion to the side of the skirt, the curvature portion being not protruded from at least the middle portion to the seal surface, and the following relationships are satisfied:

$$0.3\ \text{mm} < H2 < 0.6\ \text{mm},$$

$$0.1\ \text{mm} < R < 0.6\ \text{mm},$$

where H2 is the shortest distance from the middle portion of the corner to a seal plane, and R is a curvature radius of the curvature portion.

5. The color cathode ray tube according to claim 1, wherein the corner having the specific curvature is a single curvature.

6. The color cathode ray tube according to claim 1, wherein the corner having the specific curvature is a complex curvature.

7. The color cathode ray tube according to claim 1, wherein the panel has a substantially flat outer surface.

8. The color cathode ray tube according to claim 7, wherein the panel has an inner surface having a curvature.

9. A color cathode ray tube comprising a rectangular panel having a substantially vertically extending skirt on inner and outer surfaces of the panel and a funnel coupled to a seal edge of the skirt of the panel, wherein the seal edge of the skirt of the panel has a corner having a specific curvature between a seal surface and a side of the skirt, and the following relationship is satisfied:

$$0.3\ \text{mm} < H2 < 0.6\ \text{mm},$$

where H2 is the shortest distance from a middle portion of the corner to a seal plane.

10. The color cathode ray tube according to claim 9, wherein the corner includes an inclination portion facing in the direction from the seal surface to the side of the skirt, a middle portion extending substantially parallel to the seal surface from an end portion of the inclination portion to the side of the skirt, and a curvature portion formed to have a specific curvature radius from an end portion of the middle portion to the side of the skirt, the curvature portion being not protruded from at least the middle portion to the seal surface, and the following relationship is satisfied:

$$0.1\ \text{mm} < R < 0.6\ \text{mm},$$

where R is a curvature radius of the curvature portion.

11. The color cathode ray tube according to claim 9, wherein the corner having the specific curvature is a single curvature.

12. The color cathode ray tube according to claim 9, wherein the corner having the specific curvature is a complex curvature.

13. The color cathode ray tube according to claim 9, wherein the panel has a substantially flat outer surface.

14. The color cathode ray tube according to claim 13, wherein the panel has an inner surface having a curvature.

15. A color cathode ray tube comprising a rectangular panel having a substantially vertically extending skirt on inner and outer surfaces of the panel and a funnel coupled to a seal edge of the skirt of the panel, wherein the seal edge of the skirt of the panel has a corner having a specific curvature between a seal surface and a side of the skirt, the corner includes an inclination portion facing in the direction from the seal surface to the side of the skirt, a middle portion extending substantially parallel to the seal surface from an end portion of the inclination portion to the side of the skirt, and a curvature portion formed to have a specific curvature radius from an end portion of the middle portion to the side of the skirt, the curvature portion being not protruded from at least the middle portion to the seal surface, and the following relationship is satisfied:

$$0.1\ \text{mm} < R < 0.6\ \text{mm},$$

where R is a curvature radius of the curvature portion.

16. The color cathode ray tube according to claim 15, wherein the corner having the specific curvature is a single curvature.

17. The color cathode ray tube according to claim 15, wherein the corner having the specific curvature is a complex curvature.

18. The color cathode ray tube according to claim 15, wherein the panel has a substantially flat outer surface.

19. The color cathode ray tube according to claim 18, wherein the panel has an inner surface having a curvature.

* * * * *